United States Patent [19]

Alexander

[11] Patent Number: 4,872,832

[45] Date of Patent: Oct. 10, 1989

[54] AIR CONTROLLER FOR BURNERS

[76] Inventor: Jack L. Alexander, 260 E. 28th St., Tulsa, Okla. 74114

[21] Appl. No.: 131,855

[22] Filed: Dec. 11, 1987

[51] Int. Cl.[4] ..... F23N 3/00

[52] U.S. Cl. ..... 431/90; 251/58

[58] Field of Search ..... 431/12, 89, 90, 354; 137/100; 251/58, 229

[56] References Cited

U.S. PATENT DOCUMENTS

| | | | |
|---|---|---|---|
| 999,165 | 7/1911 | Herpin | 431/354 |
| 2,162,857 | 6/1939 | Olvitt | 431/12 |
| 3,371,699 | 3/1968 | Riot | 431/90 |
| 3,396,938 | 8/1968 | Matsui | 251/229 |
| 3,602,478 | 8/1971 | Cairns | 251/58 |
| 3,814,576 | 6/1974 | Brockhurst | 431/354 |
| 3,985,151 | 10/1976 | Smith | 251/58 X |

FOREIGN PATENT DOCUMENTS

| | | | |
|---|---|---|---|
| 2457139 | 1/1976 | Fed. Rep. of Germany | 431/90 |
| 403473 | 12/1933 | United Kingdom | 431/90 |

*Primary Examiner*—Margaret A. Focarino
*Attorney, Agent, or Firm*—Head & Johnson

[57] ABSTRACT

Air flow to a burner as controlled by the rotatable movement of an apertured plate relative to a fixed aperture plate, the rotation thereof being controlled as a function of the quantity, pressure, and/or flow of the fuel to the burner.

7 Claims, 5 Drawing Sheets

AIR FLOW
20
30
34
40
46
50
52
54
56
58
60
62
64
66
70
72
74
76
80
82
84
86
88
90
100
102
104
106
108
110
120
122
124
126
128
130
132
134
136
138
3
4
5

AIR CONTROLLER FOR BURNERS

BACKGROUND OF THE INVENTION

The field of this invention is directed to fuel burners and in particular to means to control the air flow, either primary and/or secondary air to the burner.

The control of air to a burner has historically involved the rotational movement of an apertured plate relative to a fixed apertured plate in which the cross sectional opening area, being usually transverse to the flow of air, is utilized to control proper amount of stiochiometric air to the burner for optimum fuel-air ratios. In many prior art burners, this rotation has been accomplished by hand and/or a variety of complex mechanisms. Another method of automatically controlling air to a burner comprises the reciprocal movement of a disc-type valve or air adjustment plate relative to a fixed opening. Many of such prior art methods and apparatus have inherent limitations in them, are cumbersome, and in many cases are limited in size and inoperable with regard to larger size burners operating in the range of 500,000 to 2,000,000 BTU.

SUMMARY OF THE INVENTION

This invention is directed to the object of overcoming the limitations of the prior art methods and apparatus for controlling air flow to a burner.

Further object of the invention is to provide an air flow control to a burner of the type wherein an apertured plate is rotatable relative to a fixed apertured plate and where the mechanism for causing rotational movement is simple, compact and positioned such that it does not deter or substantially interrupt the flow of air to the burner and in which the rotational movement in the mechanism therefore is actuated as a function of the quantity, pressure and/or flow of the fuel to the burner.

A specific object of the invention is to provide an adjustable air control register for a fuel burner, albeit gaseous and/or liquid that comprises a fixed member having multiple apertures therein. The fixed member is typically positioned transverse to the flow of primary and/or secondary air flow to the burner. A second apertured member is coaxially contiguous thereto one side of the fixed member and rotatable relative thereto to change the amount of air flowing through the apertures of said fixed and second member. The rotational movement occurs by means of a relative small housing that is coaxially positioned so as to be out of the air flow path and attached to the fixed member. A rotor is attached to the second rotatable member which is rotated as a function of the quantity, pressure or flow of the fuel to the burner. The rotor and its associated mechanism is located in a coaxial cavity internally of the housing. The cavity, and/or the housing is divided by a flexible diaphragm creating an inner and an outer chamber. A coaxial cylinder is formed as a part of or separately within the inner chamber. A piston, reciprocally positioned within the cylinder, has one end attached to the diaphragm and the other end within the cylinder. A cam or follower means is formed as a part of the other end of the piston. A spring means is located within the inner chamber to normally bias the piston toward the outer chamber. The rotor has one end coaxially attached to the second rotatable member. The other end of the rotor includes a follower or cam located within the inner chamber which is in contact with the respective cam or follower of the piston. The cam and the follower are designed such that reciprocation of the piston will cause the rotation of the rotor and its attached second apertured member. A flow conduit or other means communicates the quantity, pressure and/or flow of the fuel that is going through the burner to the outer chamber, which controls the rotation of the second member as a function thereof. Means are provided to limit the reciprocable movement between desired limits of air flow to the burner. This is accomplished in one embodiment by adjustable bolt members located in the outer housing and inner housing which accordingly limit the movement of the piston in both directions.

DETAILED DESCRIPTION OF THE DRAWINGS

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein is for the purpose of description and not of limitation.

Figure 1:
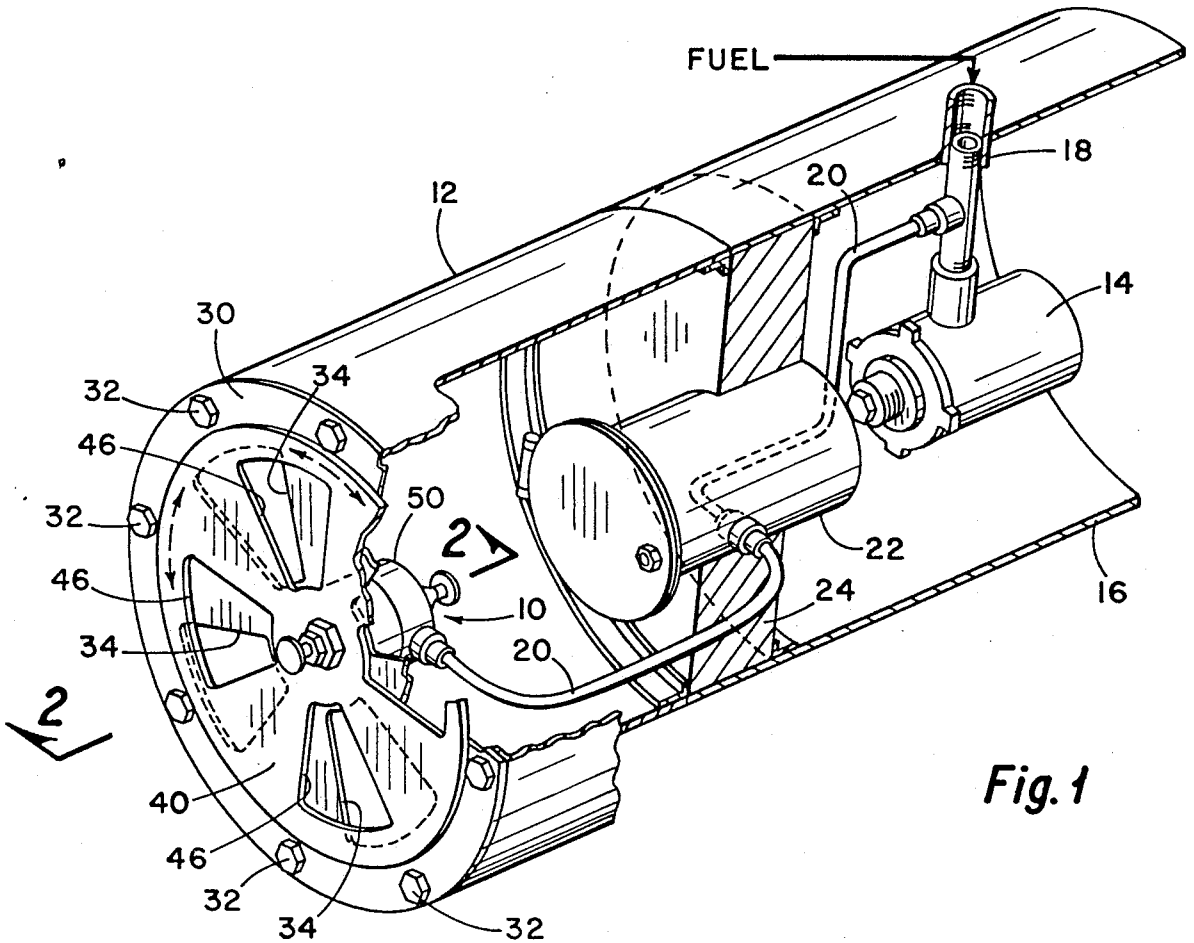
FIG. 1 is a perspective view describing a combination burner tube, burner and air controller of this invention.

Referring now to FIG. 1, the air register controller of this invention is generally designated by the numeral 10 which is attached to a burner tube 12 having a burner 14 within the firetube portion 16 of the burner tube. Fuel is supplied via conduit 18 to the burner 14. A fuel line 20 is connected to the controller 10 through a suitable connector housing means 22. Between the air control and burner tube is a flame arrester 24. The adjustable air control register comprises a fixed member 30 which is attached by suitable fasteners 32 to the burner tube. The fixed member includes a plurality of openings or apertures 34 around its circumference for the flow of air therethrough to the burner 14. A second apertured member 40 is coaxially contiguous to the fixed member 30 on one side thereof, in this embodiment on the upstream side, and is rotatable thereto, as shown by the arrows to change the amount of air flow through the apertures 34 of the fixed member. The second member comprises a plurality of apertures 46 which rotate relative to apertures 34. The means to control the rotary movement of the second member 40 occurs within control housing 50.

Figure 2:
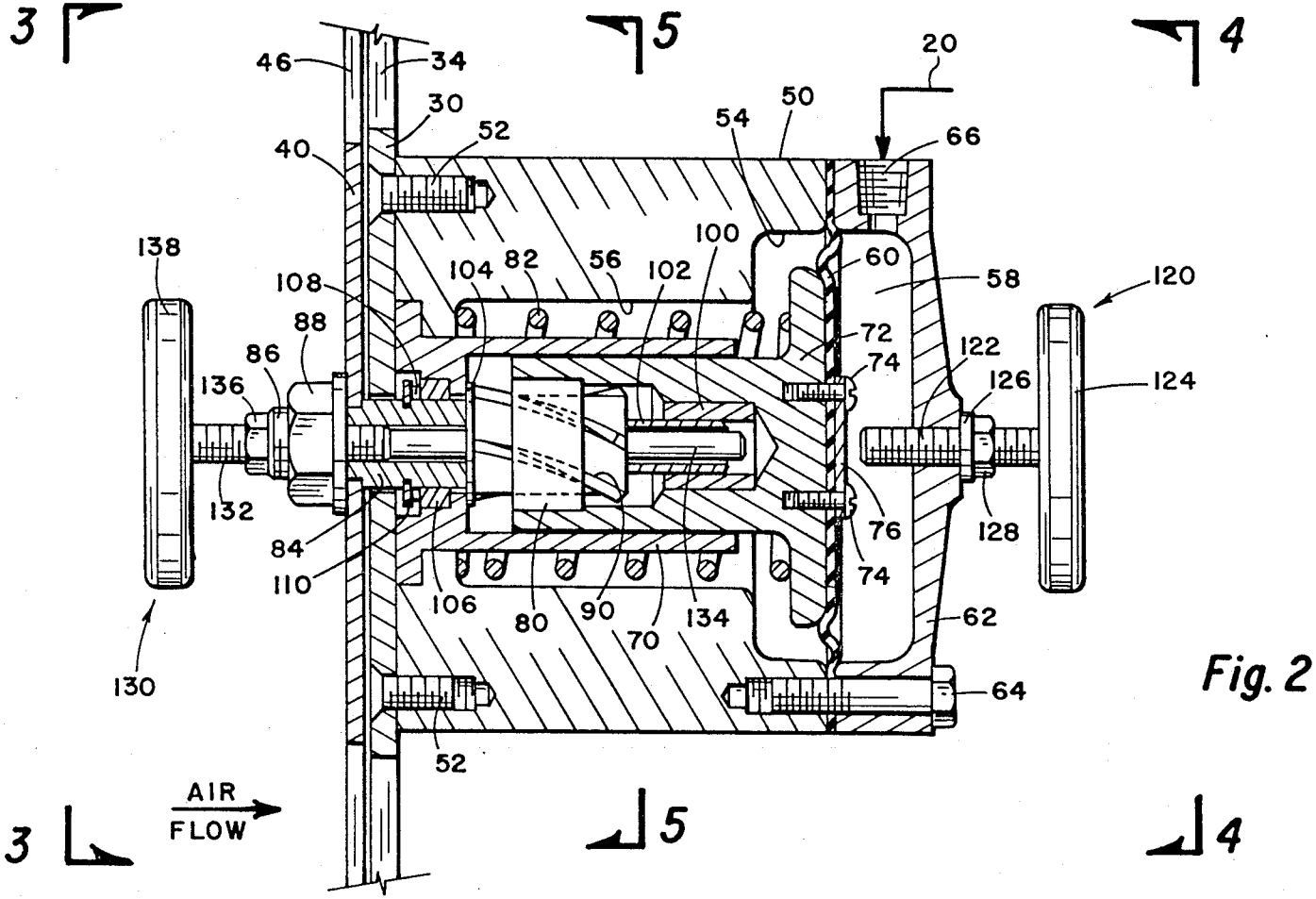
FIG. 2 is a sectional view taken along a line 2—2 of FIG. 1 with partial cutaway and partial elevational portions.
Figure 3:
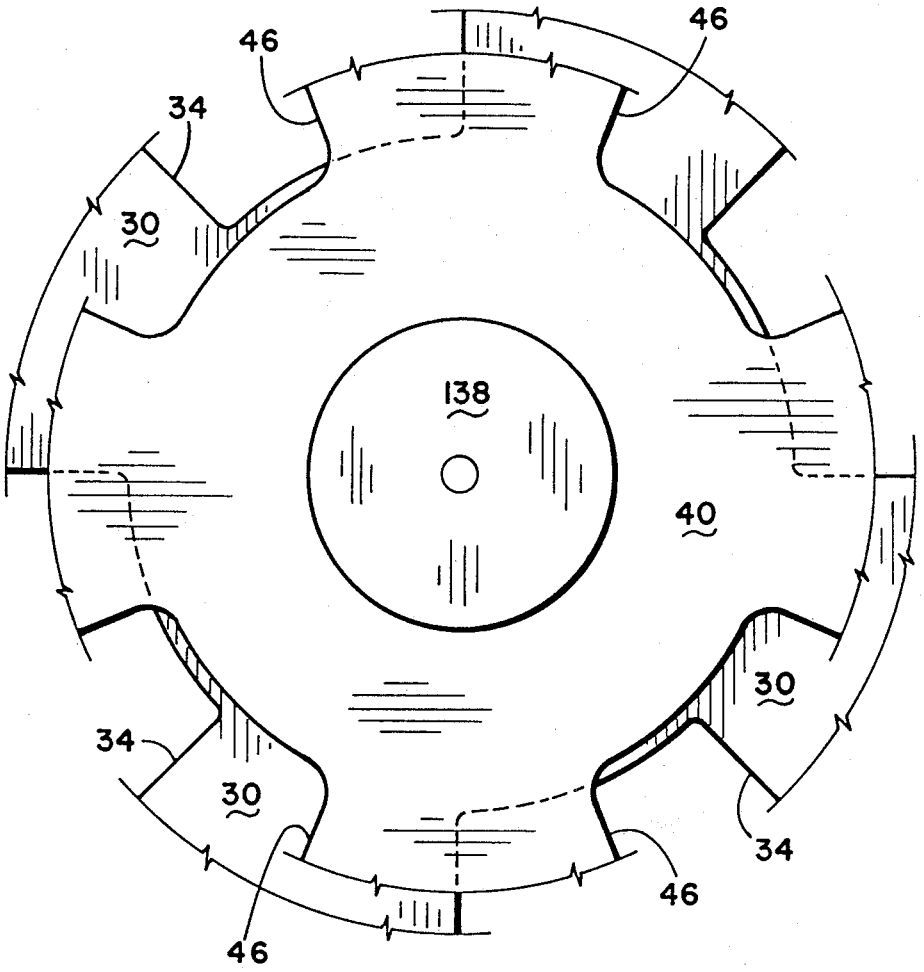
FIG. 3 is a partial elevational view taken along a line 3—3 of FIG. 2.
Figure 4:
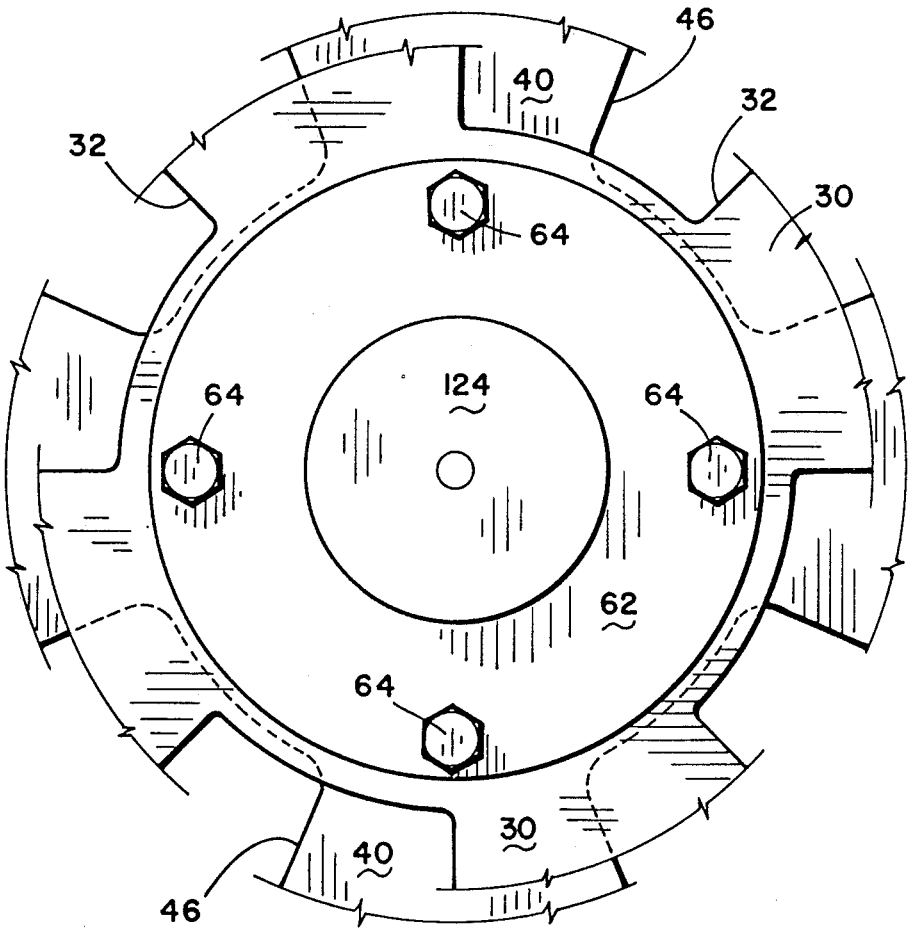
FIG. 4 is a partial elevational view taken along a line 4—4 of FIG. 2.
Figure 5:
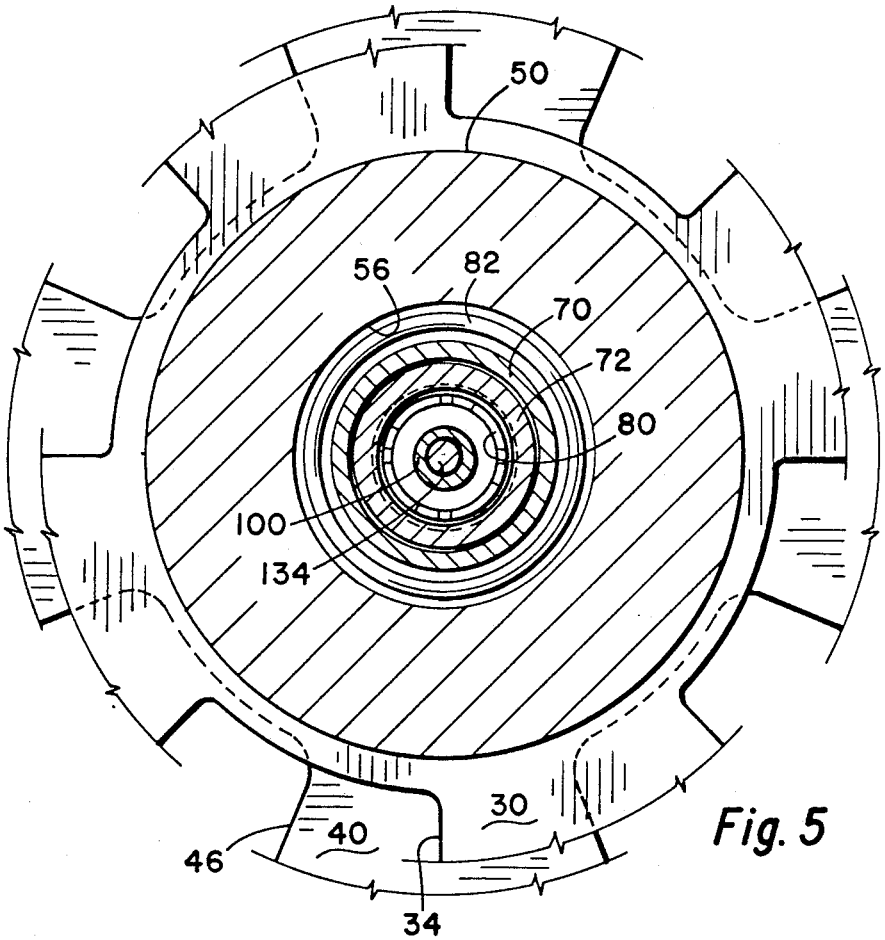
FIG. 5 is a sectional view taken along a line 5—5 of FIG. 2.

Referring now to FIG. 2, the housing 50 is attached to the fixed member 30 by plurality of fasteners 52 and is formed with an internal cavity 54 that is divided into an inner chamber 56 and an outer chamber 58 by a flexible diaphragm 60 that is retained by an outer casing 62 using plurality of fasteners 64 around the circumference thereof. A threaded opening 66 is provided within the outer casing to permit the attachment of conduit 20 for the communication of the fuel quantity, pressure and/or flow to the inner chamber to the outer chamber 58.

Within the inner chamber 56 is formed a cylindrical member 70 within which piston 72 operates. One end of the piston is attached to the diaphragm 60 using fastener 74 and plate washer 76 while the other end of the piston includes a helical cam 80. The piston is designed for reciprocal movement within the cylinder 70. A spring 82 is provided within the inner chamber to operate and bias the piston 72 in a direction toward the outer chamber 58. A rotor 84 is attached coaxially to the rotatable air control member 40 by means of a threaded bolt 86 and locknut 88. The other end of the rotor has a plurality of follower members 90 which are in contact with the cam surface 80 of the piston such that reciprocation of the piston will rotate the rotor 84 and its attached second apertured member 40. The rotor may include suitable bushings and/or bearings 100 for sliding movement of extension 102 of the rotor 84. The rotor is appropriately retained within the inner chamber by a Teflon thrust washer 104, a bushing 106, thrust washer 108 and a retaining snap ring 110. The controller includes a first adjustable stop member generally designated by the numeral 120 comprised of a bolt 122 one end of which is abutable against the plate washer 76 of the diaphragm while the other end includes a rotatable hand knob 124. The stop member is retained to the outer housing 62 by a washer 126 and bolt 128.

A second adjustable stop member is generally indicated by the numeral 130 and comprises a bolt 132 which abuts against a coaxial stop rod 134 to limit the movement of the piston 72 in the direction of movement toward the inner chamber 56. The bolt is retained in its adjusted position by being threadable through sleeve 86 and held by locknut 136. A hand wheel 138 is used to change the location of the adjustable stop member.

Figure 6:
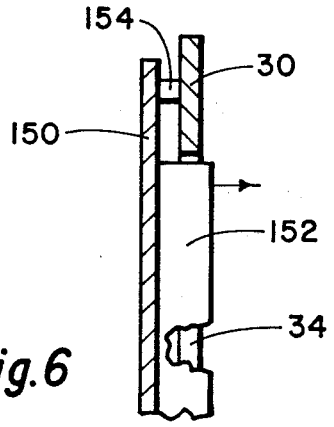
FIG. 6 is a partial sectional view of a modification of the second apertured member.

In the modification of FIG. 6 the second rotable aperture member 150 is similar to that described heretofore as item 40 except the addition of a stop flange 152 which extends transversely across the aperture 34 in the fixed apertured member 30 and abuts thereagainst. It is preferred that in the manufacture or assembly of member 150 spring tension be placed thereto, as shown by the arrow toward the member 30. TEFLON (or other friction reducing material) guides 154 such as small pads are attached to the member 150 to prevent frictional binding of the member 150 against member 30. The use of flange 152 may eliminate the need of stop adjustment 130 and/or 120 depending upon the design criteria of the burner air requirements.

In the use of the device, once the unit has been fired up and the burner set at the desired pressure, an oxygen analyzer is utilized in the exhaust stack to monitor excess oxygen at full firing pressure. Bolt 136 is loose permitting the rotation of bolt 132 by hand wheel 38 providing a limit on the reciprocal movement of piston 72 and hence the relationship of openings 46 of the rotary member to openings 34 of the fixed member. Once the desired fuel/air ratio is established, the locknut 36 is set. Thereafter burner pressure is reduced to its lowest point and the air flow limit being retained by the adjustment of bolt 122 relative to the diaphragm washer plate 76 which again moves the second member 40 and its apertures 46 relative to apertures 34 of the fixed member 30 for the desired air ratio at the lower limits of fuel.

What is claimed:

1. An adjustable air control register for a fuel burner comprising:

a fixed member having multiple apertures for the flow of air therethrough;

a second apertured member coaxially contiguous thereto on one side of said fixed member and rotatable relative thereto to change the amount of air flow through said aperture of said fixed member;

a housing coaxially attached to the other side of said fixed member, a coaxial cavity internally of said housing, said cavity divided by a flexible diaphragm into inner and outer chambers, a coaxial cylinder in said inner chamber, a piston reciprocable in said cylinder having one end attached to said diaphragm and the other end within said cylinder, cam or follower means formed as a part of said other end of said piston;

means within said inner chamber to normally bias said piston toward said outer chamber;

a rotor, said rotor having one end coaxially attached to said second member, the other end of said rotor having follower or cam means in contact with said respective cam or follower means, said cam and follower designed such that reciprocation of said piston will rotate said rotor and second member;

a first adjustable stop member in said outer chamber to limit the movement toward said outer chamber and a second adjustable stop member in said inner chamber to limit movement of said piston in direction toward said inner chamber to establish minimum and maximum amounts of air flow through said fixed member apertures, respectively; and means to communicate the quantity, pressure or flow of that is going through the burner to fuel to said outer chamber, said diaphragm being responsive thereto to automatically vary the amount of air flow through said fixed member apertures.

2. The register of claim 1 wherein said first adjustable stop member comprises a coaxial bolt threadably and sealably attached to said housing, one end of said bolt within said outer chamber, the other end outside said housing having means to rotate said bolt; and said second adjustable stop member comprises a coaxial bolt threadably and sealably attached to said second apertured member, one end of said bolt contiguous to said piston and the other end outside said second apertured member having means to rotate said bole.

3. The apparatus of claim 1 being positioned within a burner housing transverse to the flow of air to said burner.

4. The register of claim 1 wherein said second apertured member is spring biased toward said fixed member.

5. The register of claim 1 wherein said second apertured member includes a flange which extends transversely into and across said apertures of said fixed member.

6. The register of claim 1 wherein said second apertured member includes at least one friction reducing pad between said fixed member and said second member.

7. The register of claim 6 wherein said pad is plastic.

* * * * *